US010330115B2

(12) United States Patent
Chung et al.

(10) Patent No.: US 10,330,115 B2
(45) Date of Patent: Jun. 25, 2019

(54) ADJUSTING MECHANISM FOR CENTRIFUGAL COMPRESSORS

(71) Applicant: INDUSTRIAL TECHNOLOGY RESEARCH INSTITUTE, Hsinchu (TW)

(72) Inventors: Jenn-Chyi Chung, Changhua County (TW); Chung-Che Liu, Hsinchu (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 351 days.

(21) Appl. No.: 15/451,341

(22) Filed: Mar. 6, 2017

(65) Prior Publication Data

US 2018/0163749 A1 Jun. 14, 2018

(30) Foreign Application Priority Data

Dec. 9, 2016 (TW) ..... 105140766 A

(51) Int. Cl.
*F01D 17/14* (2006.01)
*F04D 29/46* (2006.01)

(52) U.S. Cl.
CPC ..... *F04D 29/464* (2013.01); *F01D 17/141* (2013.01); *F01D 17/143* (2013.01); *F01D 17/145* (2013.01); *F01D 17/146* (2013.01)

(58) Field of Classification Search
CPC .... F04D 29/464; F01D 17/141; F01D 17/143; F01D 17/145; F01D 17/146
See application file for complete search history.

(56) References Cited

U.S. PATENT DOCUMENTS 3,243,159 A 3/1966 Hefler
4,382,749 A 5/1983 Teegarden et al.
(Continued)

FOREIGN PATENT DOCUMENTS

DE 102007048274 A1 * 4/2008 ..... F01D 17/143
FR 977692 A * 4/1951 ..... F01D 17/141
(Continued)

OTHER PUBLICATIONS

DE-102007048274—Translation and original from Espacenet, Published Apr. 2008.*
(Continued)

*Primary Examiner* — Justin D Seabe
*Assistant Examiner* — Behnoush Haghighian
(74) *Attorney, Agent, or Firm* — Maschoff Brennan

(57) ABSTRACT

An adjusting mechanism, adaptive to a main body of a centrifugal compressor, comprises a diffuser channel width adjusting assembly and a gas bypass assembly. The diffuser channel width adjusting assembly comprises a width adjusting annular plate and a first valve stem. The width adjusting annular plate is movably disposed in a diffuser channel of the main body. The first valve stem is connected to the width adjusting annular plate, and configured for driving the width adjusting annular plate to move to adjust the width of the diffuser channel. The gas bypass assembly comprises a gas bypass valve and a second valve stem. The gas bypass valve is movably disposed in a gas bypass passage of the main body. The second valve stem is connected to the gas bypass valve, and configured for driving the gas bypass valve to move to adjust the opening of the gas bypass port.

10 Claims, 11 Drawing Sheets

(56) References Cited

U.S. PATENT DOCUMENTS

| | | | | |
|---|---|---|---|---|
| 4,503,684 | A * | 3/1985 | Mount | F04D 27/0246 415/14 |
| 4,527,949 | A * | 7/1985 | Kirtland | F01D 17/143 415/150 |
| 5,116,197 | A | 5/1992 | Snell | |
| 5,678,985 | A | 10/1997 | Brooke et al. | |
| 5,807,071 | A * | 9/1998 | Brasz | F04D 27/0253 415/148 |
| 6,402,431 | B1 | 6/2002 | Nish | |
| 6,427,464 | B1 | 8/2002 | Beaverson | |
| 6,872,050 | B2 | 3/2005 | Nenstiel | |
| 8,734,093 | B2 | 5/2014 | Yen et al. | |
| 2003/0010029 | A1* | 1/2003 | Lutz | F01D 17/167 60/602 |
| 2005/0262841 | A1* | 12/2005 | Parker | F01D 17/14 60/602 |
| 2008/0271449 | A1* | 11/2008 | Roberts | F01D 17/143 60/602 |
| 2012/0286066 | A1* | 11/2012 | Holroyd | F01D 17/143 239/265.11 |
| 2015/0275917 | A1* | 10/2015 | Fukuyama | F04D 27/0253 415/148 |

FOREIGN PATENT DOCUMENTS

| | | | |
|---|---|---|---|
| TW | 354817 | B | 3/1999 |
| TW | 369588 | B | 9/1999 |
| TW | M381957 | U1 | 6/2010 |
| TW | I418711 | B | 12/2013 |
| TW | I452208 | B | 9/2014 |
| TW | I507606 | B | 11/2015 |
| TW | I544151 | B2 | 8/2016 |

OTHER PUBLICATIONS

FR-977692—Translation and original from Espacenet, Published Apr. 1951.*

TW Office Action dated Jul. 27, 2017 as received in Application No. 105140766.

* cited by examiner

ADJUSTING MECHANISM FOR CENTRIFUGAL COMPRESSORS

CROSS-REFERENCE TO RELATED APPLICATIONS

This non-provisional application claims priority under 35 U.S.C. § 119(a) on Patent Application No(s). 105140766 filed in Taiwan, R.O.C. on Dec. 9, 2016, the entire contents of which are hereby incorporated by reference.

TECHNICAL FIELD

The disclosure relates to an adjusting mechanism.

BACKGROUND

The conventional method of controlling the capacity of a centrifugal chiller is primarily to regulate the rotating speed and/or the opening of an inlet guide vane at a suction inlet of the centrifugal compressor to respond to the load variations, thereby adjusting the capacity of the centrifugal chiller.

SUMMARY

One embodiment of the disclosure provides an adjusting mechanism adaptive to a main body of a centrifugal compressor. The adjusting mechanism comprises a diffuser channel width adjusting assembly and a gas bypass assembly. The diffuser channel width adjusting assembly comprises a width adjusting annular plate and a first valve stem to adjust the width of the diffuser channel. The width adjusting annular plate is configured for being movably disposed in a diffuser channel of the main body. The first valve stem is connected to the width adjusting annular plate, and is configured for driving the width adjusting annular plate to move so as to adjust the width of the diffuser channel. The gas bypass assembly comprises a gas bypass valve and a second valve stem. The gas bypass valve is configured for being movably disposed in a gas bypass passage of the main body. The second valve stem is connected to the gas bypass valve, and is configured for driving the gas bypass valve to move so as to adjust the opening of the gas bypass port.

BRIEF DESCRIPTION OF THE DRAWINGS

The present disclosure will become more fully understood from the detailed description given hereinbelow and the accompanying drawings which are given by way of illustration only and thus are not intending to limit the present disclosure and wherein.

DETAILED DESCRIPTION

Figure 1:
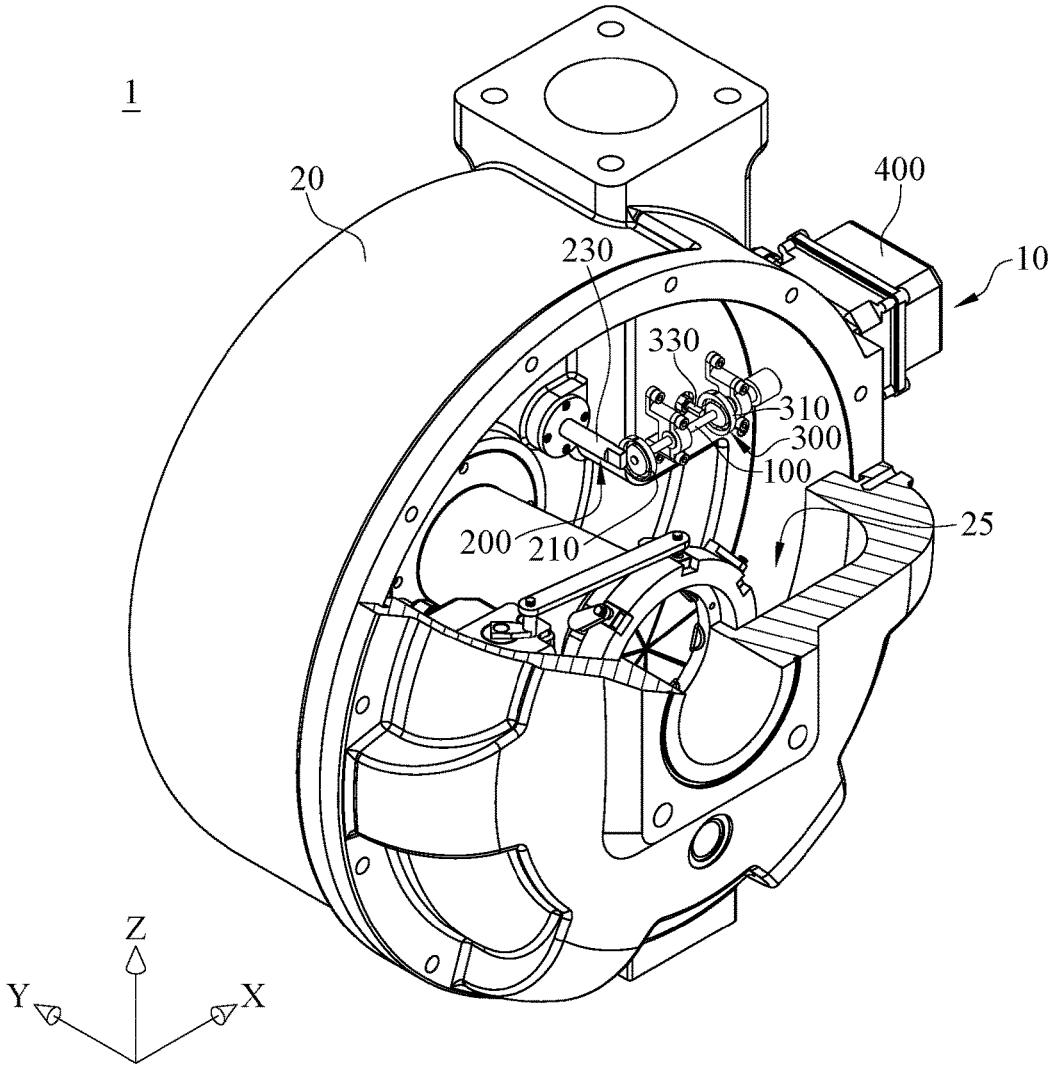
FIG. 1 is a perspective and partial cross-sectional view of a centrifugal compressor in accordance with one embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
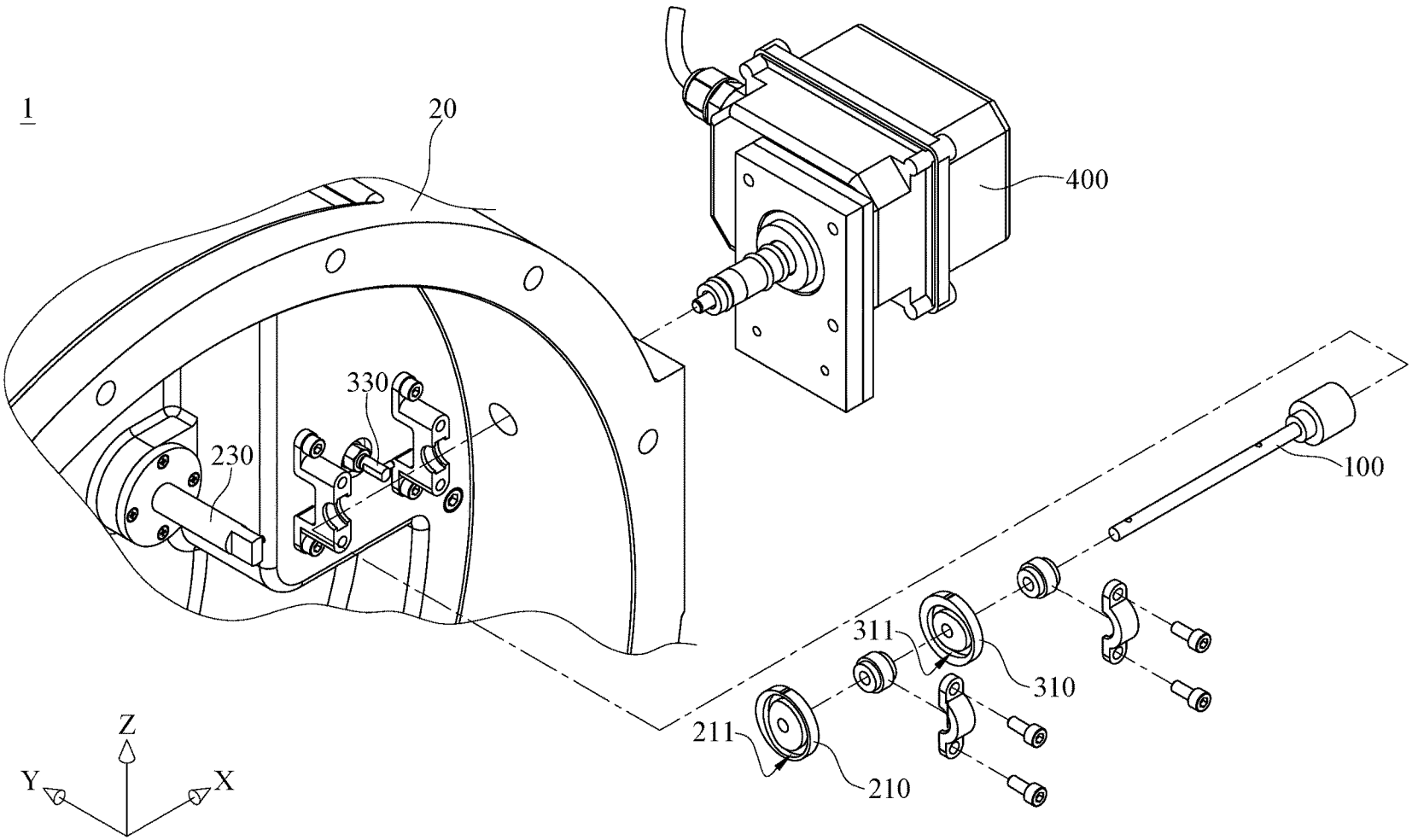
FIG. 2 is a partial exploded view of the centrifugal compressor in FIG. 1.
Figure 3:
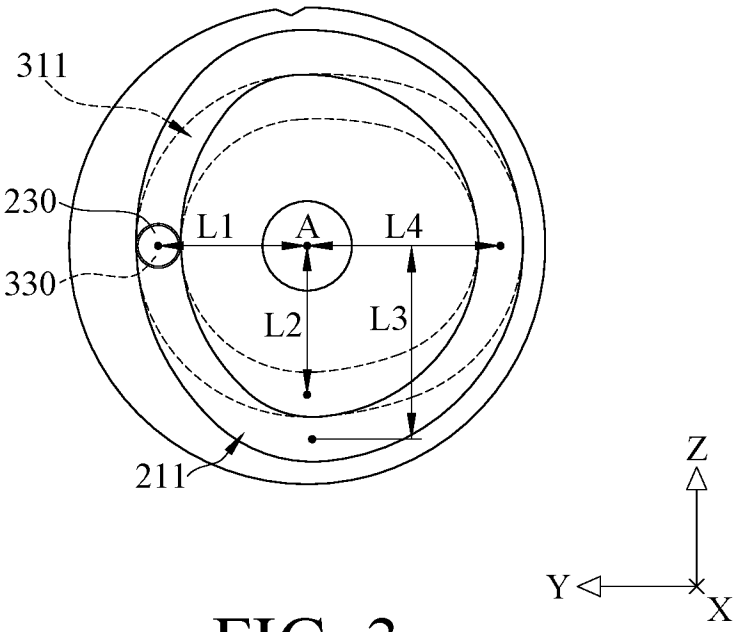
FIG. 3 is a planar view of a first box cam and a second box cam in FIG. 2.
Figure 4:
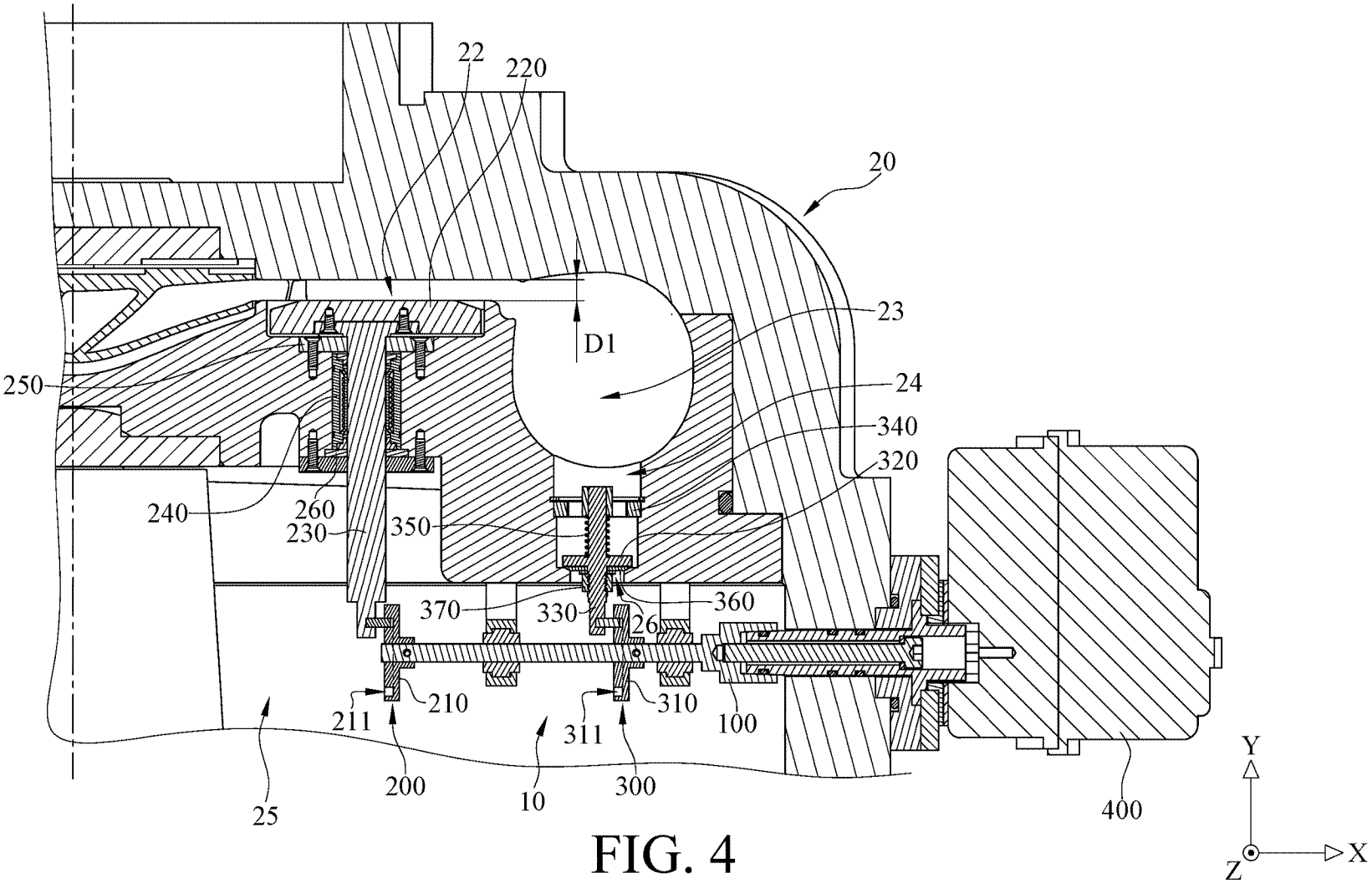
FIG. 4 is a partial cross-sectional view of the centrifugal compressor in FIG. 1.

Please refer to FIG. 1 to FIG. 4. FIG. 1 is a perspective and partial cross-sectional view of a centrifugal compressor in accordance with one embodiment of the disclosure. FIG. 2 is a partial exploded view of the centrifugal compressor in FIG. 1. FIG. 3 is a planar view of a first box cam and a second box cam in FIG. 2. FIG. 4 is a partial cross-sectional view of the centrifugal compressor in FIG. 1.

As shown in FIG. 1, FIG. 2 and FIG. 4, a centrifugal compressor 1 includes an adjusting mechanism 10 and a main body 20. The main body 20 has a diffuser channel 22, a volute 23 and a gas bypass passage 24. The diffuser channel 22 and the gas bypass passage 24 are connected to the volute 23, and one side of the gas bypass passage 24 has a gas bypass port 26. The gas bypass port 26 is connected to an inlet chamber 25 of the main body 20.

The adjusting mechanism 10 includes a drive shaft 100, a diffuser channel width adjusting assembly 200, a gas bypass assembly 300 and an actuator 400.

The drive shaft 100 is rotatably disposed in the main body 20. The diffuser channel width adjusting assembly 200 includes a first box cam 210, a width adjusting annular plate 220 and a first valve stem 230. The first box cam 210 is disposed on the drive shaft 100 and has a first cam groove 211. A distance between a part of the first cam groove 211 and an axis A of the drive shaft 100 is different from a distance between another part of the first cam groove 211 and the axis A of the drive shaft 100.

As shown in FIG. 3, in this embodiment, a distance L1 between a part of the first cam groove 211 on the positive Y-direction side relative to the axis A and the axis A is less than a distance L3 between another part of the first cam groove 211 on the negative Z-direction side relative to the axis A and the axis A. Also, the distance L3 is equal to a distance L4 between another part of the first cam groove 211 on the negative Y-direction side relative to the axis A and the axis A. However, the present disclosure is not limited thereto. In other embodiments, the path of the first cam groove may be adjusted according to actual requirements.

As shown in FIG. 2 and FIG. 4, the width adjusting annular plate 220 is movably disposed at the diffuser channel 22 of the main body 20. One end of the first valve stem 230 is slidably located in the first cam groove 211, and the other end of the first valve stem 230 is connected to the width adjusting annular plate 220 in order to drive the width adjusting annular plate 220 to move, thereby adjusting a width D1 of the diffuser channel 22.

In this embodiment, the diffuser channel width adjusting assembly 200 further includes a shaft bearing 240 and two shaft bearing fixing rings 250 and 260. The shaft bearing 240 is, for example, a linear bearing. The shaft bearing 240 is disposed on the main body 20. The shaft bearing fixing rings 250 and 260 are disposed on the main body 20. The shaft bearing 240 is located between and pressed by the two shaft bearing fixing rings 250 and 260. The first valve stem 230 penetrates through the shaft bearing 240 and the two shaft bearing fixing rings 250 and 260, so that the smoothness of linear movement of the first valve stem 230 is improved by the shaft bearing 240.

As shown in FIG. 2 and FIG. 4, the gas bypass assembly 300 includes a second box cam 310, a gas bypass valve 320 and a second valve stem 330. The second box cam 310 is disposed on the drive shaft 100 and has a second cam groove 311. A distance between a part of the second cam groove 311 and the axis A of the drive shaft 100 is different from a distance between another part of the second cam groove 311 and the axis A of the drive shaft 100. As shown in FIG. 3, in this embodiment, the distance L1 between a part of the second cam groove 311 on the positive Y-direction side relative to the axis A and the axis A is equal to a distance L2 between another part of the second cam groove 311 on the negative Z-direction side relative to the axis A and the axis A. Also, the distance L2 is less than the distance L4 between a part of the second cam groove 311 on the negative Y-direction side relative to the axis A and the axis A. However, the present disclosure is not limited thereto. In other embodiments, the path of the first cam groove may be adjusted according to actual requirements.

As shown in FIG. 2 and FIG. 4, the gas bypass valve 320 is movably disposed in the gas bypass passage 24 of the main body 20. One end of the second valve stem 330 is slidably located in second cam groove 311, and the other end of the second valve stem 330 is connected to the gas bypass valve 320 in order to drive the gas bypass valve 320 to move, thereby opening or closing the gas bypass port 26.

In this embodiment, the gas bypass assembly 300 further includes a fixed base 340, a compression spring 350, an airtight gasket 360 and a fixing nut 370. The fixed base 340 is fixed in the main body 20. The second valve stem 330 is slidably disposed on the fixed base 340, and the gas bypass valve 320 is located on a side of the fixed base 340 close to the drive shaft 100 in order to close the gas bypass port 26. The fixing nut 370 is located on a side of the gas bypass valve 320 close to the drive shaft 100. The airtight gasket 360 is located between and pressed by the fixing nut 370 and the gas bypass valve 320. Therefore, the gas bypass valve 320 is able to seal the gas bypass port 26 via the airtight gasket 360.

The compression spring 350 is located between and pressed by the fixed base 340 and the gas bypass valve 320, and the compression spring 350 constantly forces the gas bypass valve 320 to seal the gas bypass port 26.

The actuator 400 is, for example, a motor. The drive shaft 100 is connected to the actuator 400, so that the actuator 400 is able to drive the drive shaft 100 to rotate either clockwise or counterclockwise.

Please refer to FIG. 3 to FIG. 10. FIG. 5 to FIG. 10 show the operation of the centrifugal compressor in FIG. 1. As shown in FIG. 3 and FIG. 4, the drive shaft 100 is at a start position, and the drive shaft 100 is at a first rotation angle (such as around 0 degree) while it is at the start position. In such a case, one end of the first valve stem 230 and one end of the second valve stem 330 are respectively guided by the first cam groove 211 and the second cam groove 311, and a distance from the position of one end of the first valve stem 230 located in the first cam groove 211 to the axis A of the drive shaft 100 is equal to a distance from the position of one end of the second valve stem 330 located in the second cam groove 311 to the axis A of the drive shaft 100. As a result, the first valve stem 230 is able to drive the width adjusting annular plate 220 to move to a position relatively close to the drive shaft 100. As shown in FIG. 4, the width of the diffuser channel 22 has a first width D1. The first width D1 is, for example, 7 millimeters (mm). The second valve stem 330 is able to drive the gas bypass valve 320 to move to a position relatively close to the drive shaft 100 in order to seal the gas bypass port 26.

Figure 5:
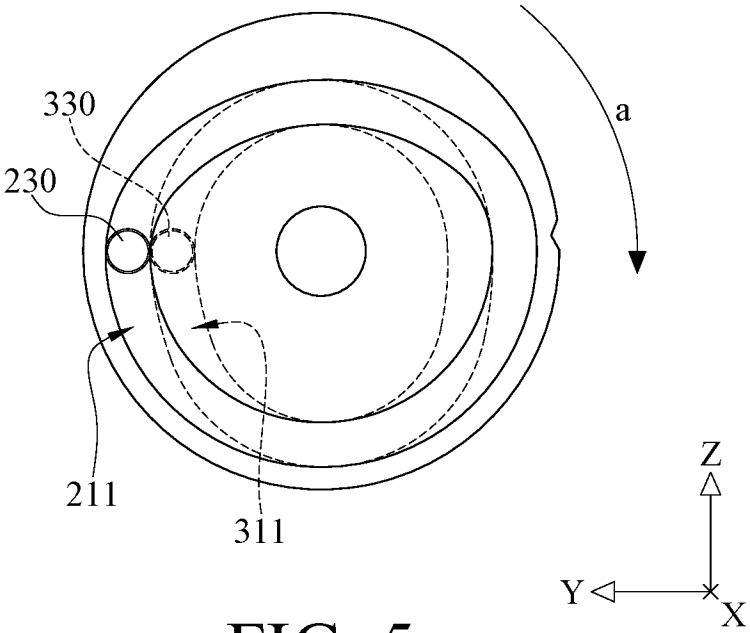
FIG. 5 to FIG. 10 show the operation of the centrifugal compressor in FIG. 1.
Figure 6:
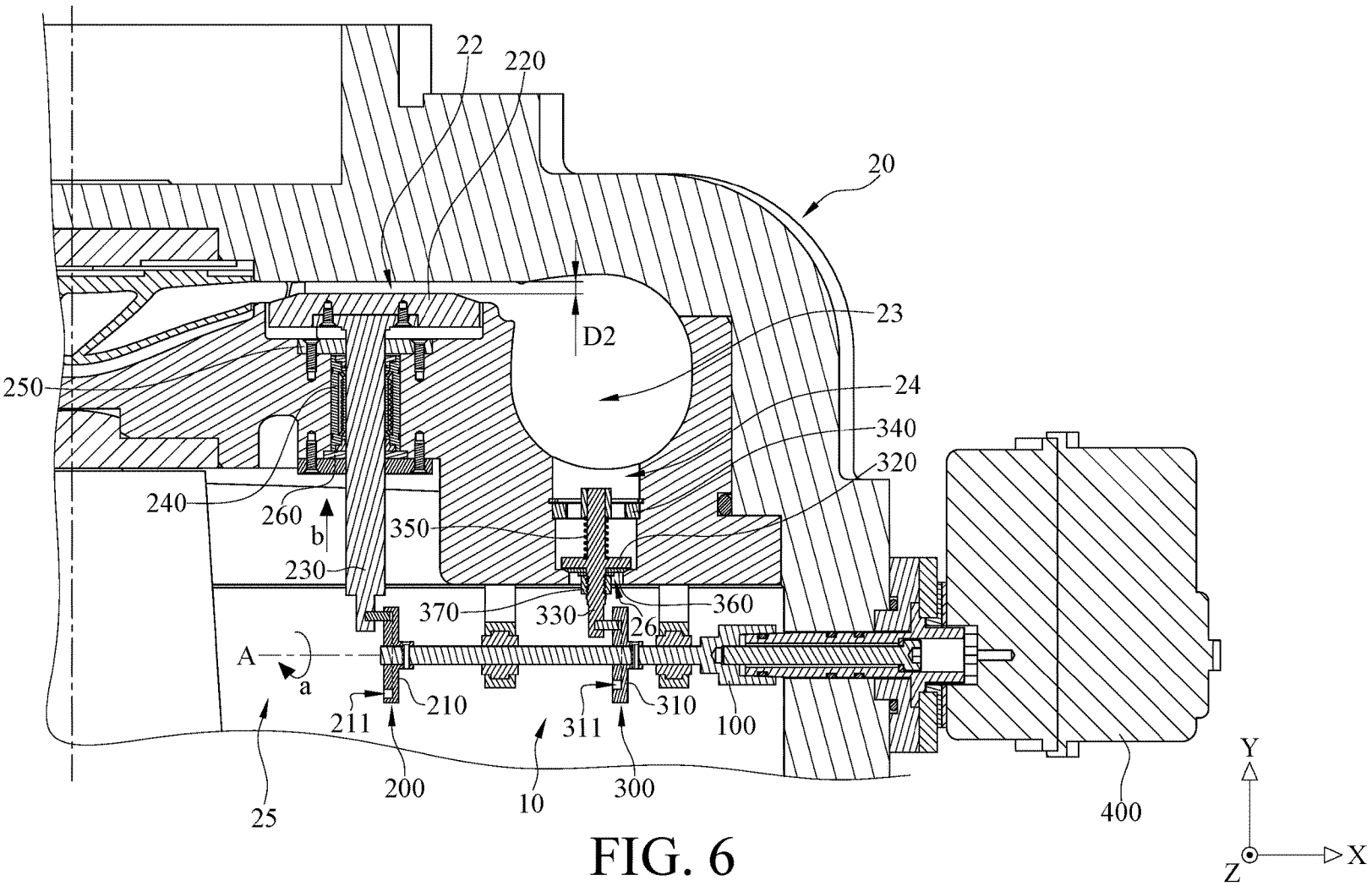

Then, as shown in FIG. 5 and FIG. 6, when the drive shaft 100 is rotated to a second rotation angle (such as around 90 degrees) along a direction of arrow a, one end of the first valve stem 230 and one end of the second valve stem 330 are respectively guided by the first cam groove 211 and the second cam groove 311, the distance from the position of one end of the first valve stem 230 located in the first cam groove 211 to the axis A of the drive shaft 100 becomes greater (L3>L1, as shown in FIG. 3), and the distance from the position of one end of the second valve stem 330 located in the second cam groove 311 to the axis A of the drive shaft 100 remains the same (L2=L1, as shown in FIG. 3). As a result, the first valve stem 230 is able to drive the width adjusting annular plate 220 to move to a position relatively away from the drive shaft 100. As shown in FIG. 6, the diffuser channel 22 has a second width D2. The second width D2 is, for example, 3 mm. The second valve stem 330 keeps the gas bypass valve 320 at the position relatively close to the drive shaft 100, and the gas bypass port 26 is remained closed.

Figure 7:
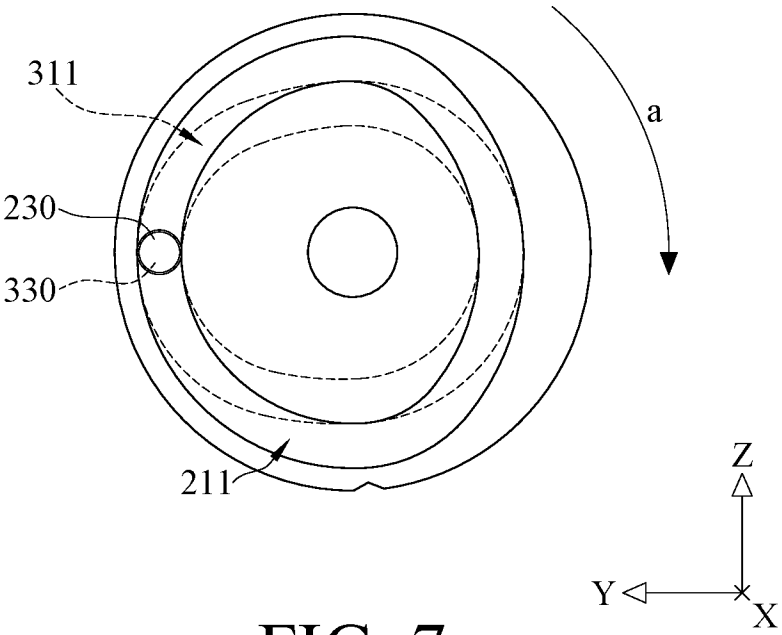
Figure 8:
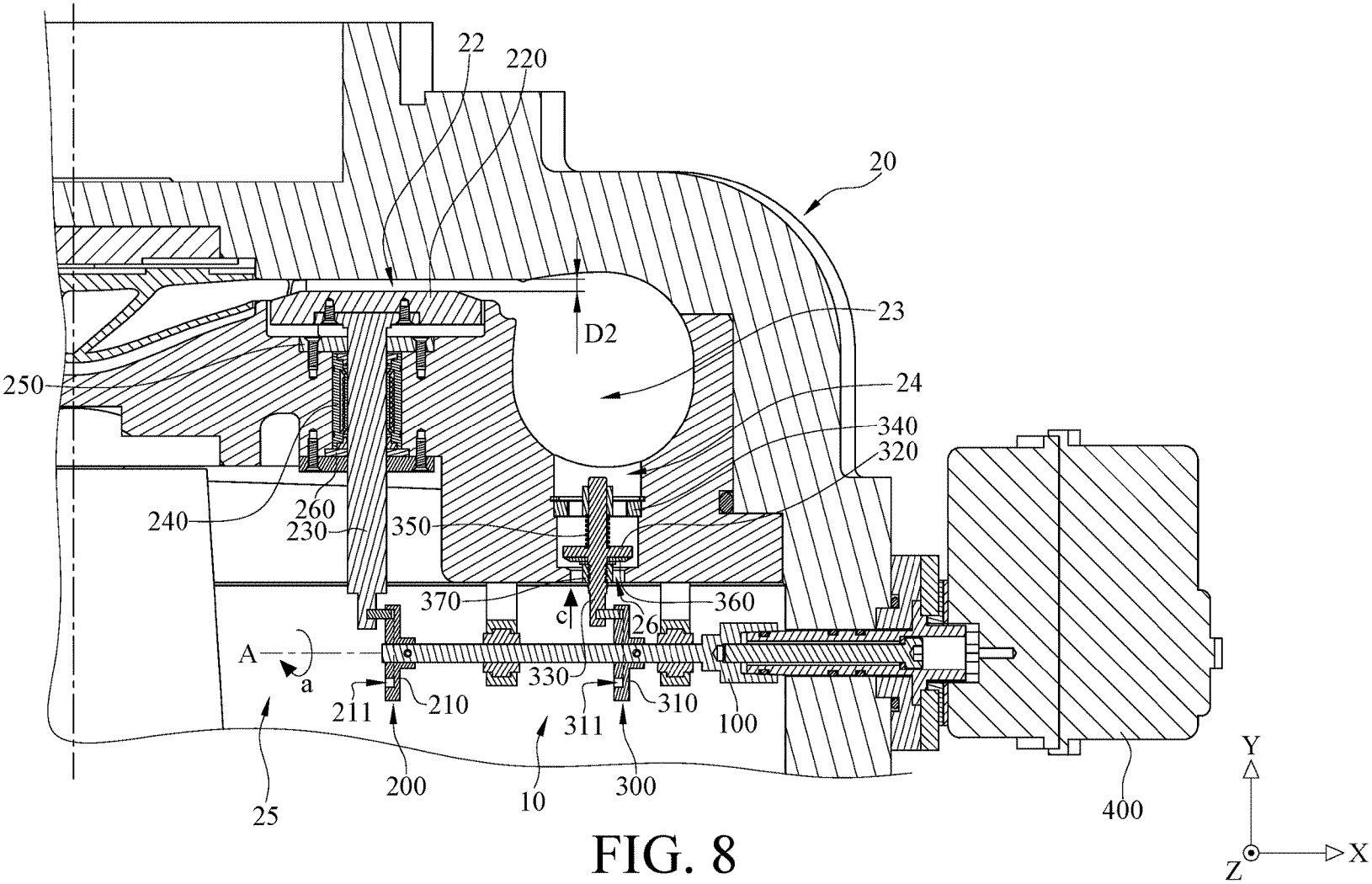

Then, as shown in FIG. 7 and FIG. 8, when the drive shaft 100 is kept rotating along the direction of arrow a to a third rotation angle (such as around 180 degrees), one end of the first valve stem 230 and one end of the second valve stem 330 are respectively guided by the first cam groove 211 and the second cam groove 311, the distance from the position of one end of the first valve stem 230 located in the first cam groove 211 to the axis A of the drive shaft 100 remains the same (L3=L4, as shown in FIG. 3), and the distance from the position of one end of the second valve stem 330 located in the second cam groove 311 to the axis A of the drive shaft 100 becomes greater (L4>L2, as shown in FIG. 3). As a result, the diffuser channel 22 is kept in the second width D2. The second valve stem 330 is able to drive the gas bypass valve 320 to move to a position relatively away from the drive shaft 100 in order to open the gas bypass port 26.

Figure 9:
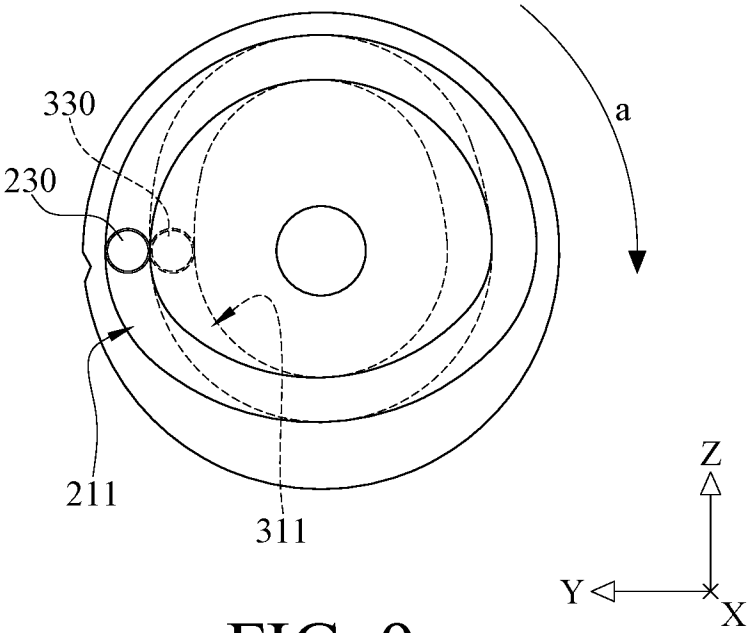
Figure 10:
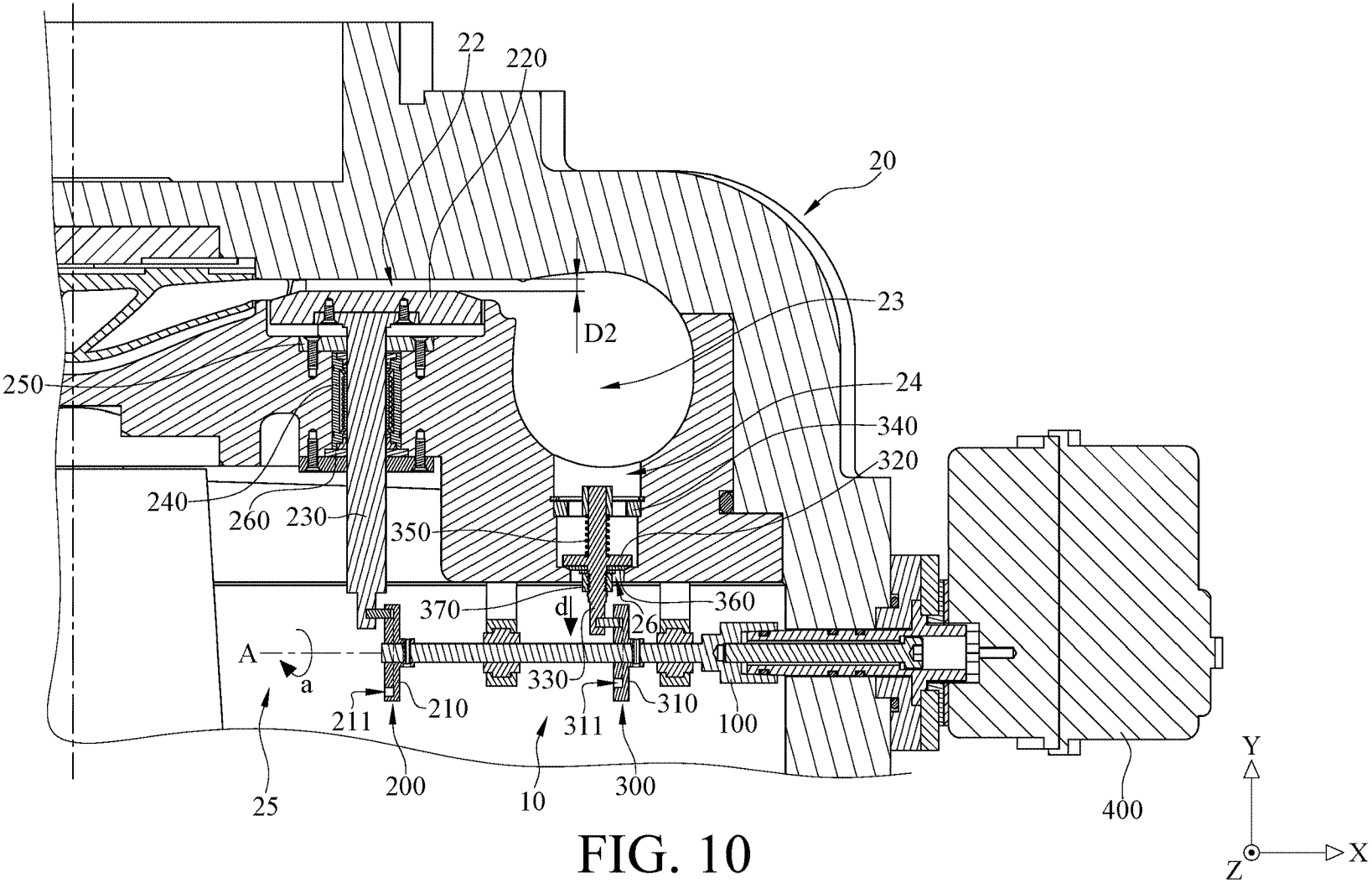

Then, as shown in FIG. 9 and FIG. 10, when the drive shaft 100 is kept rotating along the direction of arrow a to a fourth rotation angle (such as around 270 degrees), one end of the first valve stem 230 and one end of the second valve stem 330 are respectively guided by the first cam groove 211 and the second cam groove 311, the distance from the position of one end of the first valve stem 230 located in the first cam groove 211 to the axis A of the drive shaft 100 remains the same (L4=L3, as shown in FIG. 3), and the distance from the position of one end of the second valve stem 330 located in the second cam groove 311 to the axis A of the drive shaft 100 becomes smaller (L2<L4, as shown in FIG. 3). As a result, the diffuser channel 22 is kept in the second width D2. The second valve stem 330 is able to drive the gas bypass valve 320 to move to the position relatively close to the drive shaft 100 in order to close the gas bypass port 26.

It is noted that if the drive shaft 100 is kept rotating along the direction of arrow a, the drive shaft 100 will be back to the condition as it is at the first rotation angle (such as around 0 degree).

As the aforementioned operation as discussed, while the drive shaft 100 is rotated within a first rotation angle range (e.g. 0 degree to 90 degrees), the distance from the position of one end of the first valve stem 230 located in the first cam groove 211 to the axis A of the drive shaft 100 varies; while the drive shaft 100 is rotated within a second rotation angle range (e.g. 90 degrees to 180 degrees) which is different from the first rotation angle range, the distance from the position of one end of the first valve stem 230 located in the first cam groove 211 to the axis A of the drive shaft 100 is fixed.

In addition, while the drive shaft 100 is rotated within the first rotation angle range (e.g. 0 degree to 90 degrees), the distance from the position of one end of the second valve stem 330 located in the second cam groove 311 to the axis A of the drive shaft 100 is fixed; while the drive shaft 100 is rotated within the second rotation angle range (e.g. 90 degrees to 180 degrees) which is different from the first rotation angle range, the distance from the position of one end of the second valve stem 330 located in the second cam groove 311 to the axis A of the drive shaft 100 varies.

According to the embodiment as described above, the combination of controlling the width of the diffuser channel 22 and controlling the gas bypass port 26 is favorable for expanding the operating envelope of the centrifugal compressor 1 and preventing surge. Taking a 200USRT single-stage R134a refrigerant centrifugal compressor for example, its rated rotational speed is 23,000 rpm, and its predetermined pressure ratio (Pr) is 2.58. Given the condition that the pressure ratio is 2.2 and the rotational speed is 20,460 rpm when in actual operation. If the width of the diffuser channel 22 is 7 mm, the velocity of the refrigerant gas flow through the diffuser channel 22 is reduced when the mass flow rate of the refrigerant gas of the centrifugal compressor 1 is less than 3.7 kg/s. However, if the width of the diffuser channel 22 is reduced from 7 mm to 3 mm, the velocity of the refrigerant gas flow is able to maintain the stable operation of the centrifugal compressor 1 until the mass flow rate is less than 3.15 kg/s, which means that the operating envelope of the centrifugal compressor 1 is expanded. The phrase "operating envelope of the centrifugal compressor" means a range of the mass flow rate of the refrigerant gas flowing in the centrifugal compressor that can maintain the stable operation of the centrifugal compressor. When the width is reduced from 7 mm to 3 mm while the centrifugal compressor 1 is operated at the same pressure ratio and the same rotational speed, the mass flow rate of the refrigerant gas of the centrifugal compressor is dropped from 3.7 kg/s to 3.15 kg/s without stalling the centrifugal compressor 1; that is, the refrigeration capacity is reduced by 24.4 refrigeration tons, and the percentage of operating envelope is raised by 12.2%, which clearly shows that the adjustment of the width of the diffuser channel 22 having significant effect on reducing the operating capacity of the centrifugal compressor 1 but without stalling the centrifugal compressor 1. The operating capacity of the centrifugal compressor 1 can be further reduced when the adjustment of the width of the diffuser channel 22 is cooperated with the control of the gas bypass port 26. As a result, the operating envelope of the centrifugal compressor 1 is further expanded.

In addition, by the design of the coupling mechanism, the width of the diffuser channel and the opening of the gas bypass port are able to be adjusted simultaneously by one actuator and one drive shaft.

Furthermore, the design of the diffuser channel width adjusting mechanism and the gas bypass valve opening adjusting mechanism coupled in the centrifugal compressor has positive effect on adjusting capacity and expanding the operating envelope for preventing the compressor surge.

Moreover, the adjusting mechanism is favorable for simplifying the piping of the centrifugal chiller, reducing the complexity of controlling the centrifugal chiller, and reducing the piping cost of the centrifugal chiller.

In the aforementioned embodiment, although the drive shaft 100 and the second valve stem 330 are driven by the second box cam 310 which has the second cam groove 311, but the present disclosure is not limited thereto. In other embodiments, the drive shaft 100 and the second valve stem 330 may be driven by a gear and rack assembly.

Figure 11:
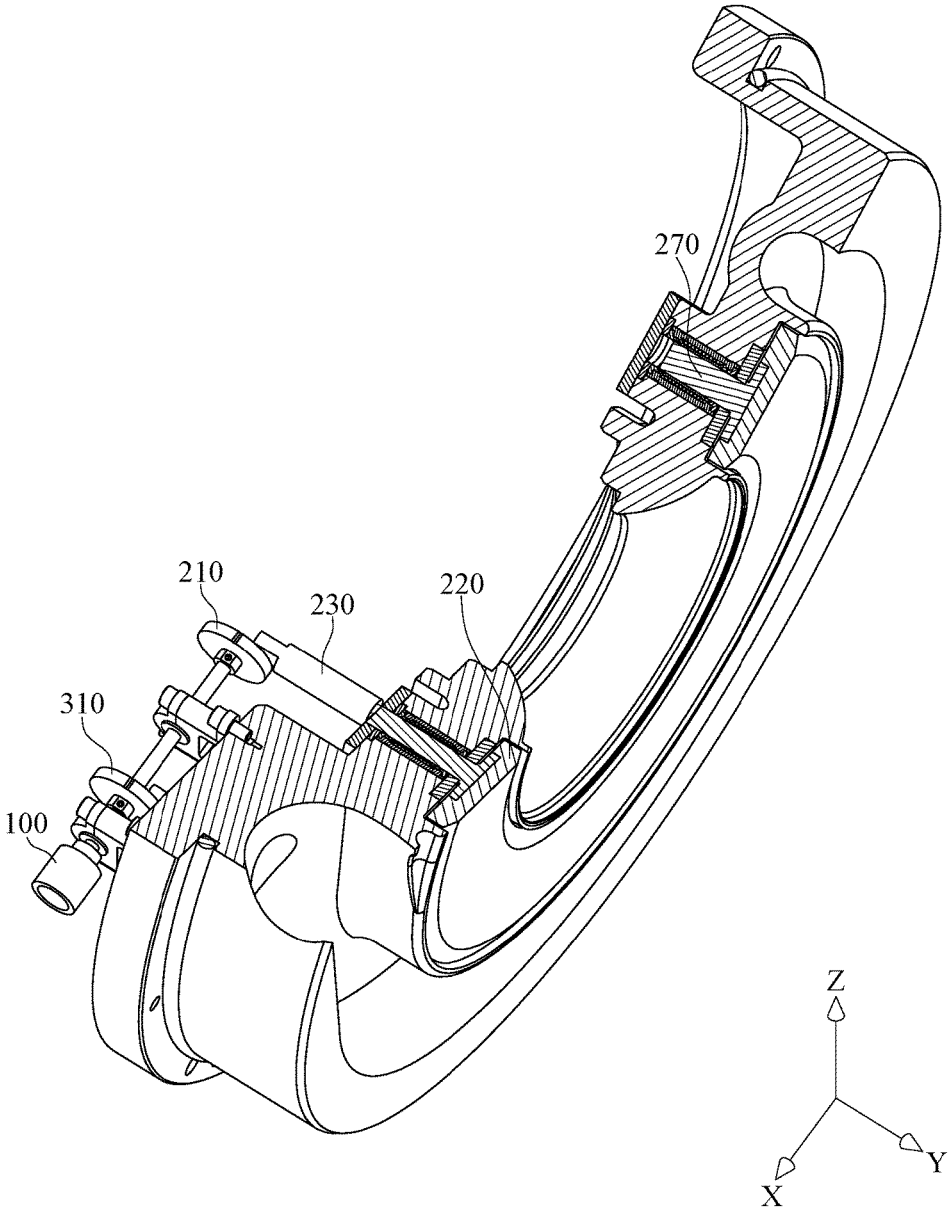
FIG. 11 is a perspective and partial cross-sectional view of a diffuser channel width adjusting assembly and a drive shaft in accordance with the embodiment of the disclosure in FIG. 1.

Please refer to FIG. 11. FIG. 11 is a perspective and partial cross-sectional view of a diffuser channel width adjusting assembly and a drive shaft in accordance with the embodiment of the disclosure.

In this embodiment, the diffuser channel width adjusting assembly 200 further includes a plurality of support rods 270. One end of each support rod 270 is connected to the width adjusting annular plate 220, and the other end of each support rod 270 is movably disposed on main body 20. The movement of the width adjusting annular plate 220 is in a smooth manner when the width adjusting annular plate 220 is pushed by the first valve stem 230 and the support rods 270 together.

According to the adjusting mechanism for the centrifugal compressor as described above, through the combination of controlling the width of the diffuser channel and the opening of the gas bypass port, the velocity of the refrigerant gas flow is raised by reducing the width of the diffuser channel while the centrifugal compressor is operated at the same pressure ratio and rotational speed, thereby preventing the compressor surge caused by the decreasing of refrigerant gas flow. As a result, the operating envelope of the centrifugal compressor is expanded.

The embodiments were chosen and described in order to best explain the principles of the disclosure and its practical applications, to thereby enable others skilled in the art to best utilize the disclosure and various embodiments with various modifications as are suited to the particular use contemplated. It is intended that the scope of the disclosure be defined by the following claims and their equivalents.

What is claimed is:

1. An adjusting mechanism adaptive to a main body of a centrifugal compressor, the adjusting mechanism comprising:

a diffuser channel width adjusting assembly, comprising:

a width adjusting annular plate configured for being movably disposed in a diffuser channel of the main body; and a first valve stem connected to the width adjusting annular plate, the first valve stem configured for driving the width adjusting annular plate to move so as to adjust the width of the diffuser channel; and a gas bypass assembly, comprising:

a gas bypass valve configured for being movably disposed in a gas bypass passage of the main body; and a second valve stem connected to the gas bypass valve, the second valve stem configured for driving the gas bypass valve to move so as to adjust the opening of a gas bypass port.

2. The adjusting mechanism according to claim 1, further comprising a drive shaft, the diffuser channel width adjusting assembly further comprising a first box cam, the first box cam disposed on the drive shaft and having a first cam groove, a distance between a part of the first cam groove and an axis of the drive shaft different from a distance between another part of the first cam groove and the axis of the drive shaft, one end of the first valve stem slidably located in the first cam groove, another end of the first valve stem connected to the width adjusting annular plate in order to drive the width adjusting annular plate to move.

3. The adjusting mechanism according to claim 2, wherein the gas bypass assembly further comprises a second box cam, the second box cam is disposed on the drive shaft and has a second cam groove, a distance between a part of the second cam groove and the axis of the drive shaft different from a distance between another part of the second cam groove and the axis of the drive shaft, one end of the second valve stem is slidably located in the second cam groove, another end of the second valve stem is connected to the gas bypass valve in order to drive the gas bypass valve to move.

4. The adjusting mechanism according to claim 3, wherein when the drive shaft is rotated within a first rotation angle range, the distance from the position of one end of the first valve stem located in the first cam groove to the axis of the drive shaft varies; when the drive shaft is rotated within a second rotation angle range which is different from the first rotation angle range, the distance from the position of one end of the first valve stem located in the first cam groove to the axis of the drive shaft is fixed.

5. The adjusting mechanism according to claim 3, wherein when the drive shaft is rotated within a first rotation angle range, the distance from the position of one end of the second valve stem located in the second cam groove to the axis of the drive shaft is fixed; when the drive shaft is rotated within a second rotation angle range which is different from the first rotation angle range, the distance from the position of one end of the second valve stem located in the second cam groove to the axis of the drive shaft varies.

6. The adjusting mechanism according to claim 5, wherein when the drive shaft is at a first rotation angle, the distance from the position of one end of the first valve stem located in the first cam groove to the axis of the drive shaft is equal to the distance from the position of one end of the second valve stem located in the second cam groove to the axis of the drive shaft; when the drive shaft is rotated to a second rotation angle which is different from the first rotation angle, the distance from the position of one end of the first valve stem located in the first cam groove to the axis of the drive shaft is different from the distance from the position of one end of the second valve stem located in the second cam groove to the axis of the drive shaft.

7. The adjusting mechanism according to claim 1, wherein the diffuser channel width adjusting assembly further comprises a plurality of support rods, one end of each support rod is connected to the width adjusting annular plate, and another end of each support rod is movably disposed on the main body.

8. The adjusting mechanism according to claim 1, wherein the diffuser channel width adjusting assembly further comprises a shaft bearing and two shaft bearing fixing rings, the shaft bearing is disposed on the main body, the shaft bearing fixing rings are respectively disposed on the main body, and the shaft bearing is located between and pressed by the two shaft bearing fixing rings.

9. The adjusting mechanism according to claim 2, wherein the gas bypass assembly further comprises a fixed base, a compression spring, an airtight gasket and a fixing nut; the fixing nut, the airtight gasket, the compression spring and the fixed base are sleeved on the second valve stem in sequence in a direction away from the drive shaft; the compression spring is located between and pressed by the gas bypass valve and the fixed base, and is configured for constantly forcing the gas bypass valve to close the gas bypass port.

10. The adjusting mechanism according to claim 2, further comprising an actuator connected to the drive shaft, and the actuator configured for driving the drive shaft to rotate.

* * * * *